US009801473B2

(12) United States Patent
Jackson et al.

(10) Patent No.: US 9,801,473 B2
(45) Date of Patent: Oct. 31, 2017

(54) PLAY YARD WITH REMOVABLE LINER

(71) Applicant: KIDS II, INC., Atlanta, GA (US)

(72) Inventors: Peter Jackson, Alpharetta, GA (US); Chaitanya Tadipatri, Alpharetta, GA (US); John M. Thomson, Johns Creek, GA (US)

(73) Assignee: KIDS II, INC., Atlanta, GA (US)

( * ) Notice: Subject to any disclaimer, the term of this patent is extended or adjusted under 35 U.S.C. 154(b) by 293 days.

(21) Appl. No.: 14/025,397

(22) Filed: Sep. 12, 2013

(65) Prior Publication Data

US 2014/0068857 A1 Mar. 13, 2014

Related U.S. Application Data

(60) Provisional application No. 61/700,828, filed on Sep. 13, 2012.

(51) Int. Cl.
*A47D 13/06* (2006.01)

(52) U.S. Cl.
CPC ..... *A47D 13/06* (2013.01); *A47D 13/063* (2013.01)

(58) Field of Classification Search
CPC . A47D 7/00; A47D 7/002; A47D 7/01; A47D 7/04; A47D 9/00; A47D 9/005; A47D 13/063; A47D 13/06; A47D 13/061
See application file for complete search history.

(56) References Cited

U.S. PATENT DOCUMENTS

| | | | |
|---|---|---|---|
| 485,081 | A | 10/1892 | Baird |
| 548,901 | A | 10/1895 | Welch |
| 1,183,819 | A | 5/1916 | Keiser |
| 1,374,333 | A | 4/1921 | Stotler et al. |
| 2,128,978 | A | 9/1938 | Akin |
| 2,287,907 | A | 6/1942 | Schettler, Jr. |
| 2,423,402 | A | 7/1947 | Olsen |
| 2,493,181 | A | 1/1950 | Andersen, Jr. |
| 2,563,915 | A | 8/1951 | Boisselier |
| 2,566,790 | A | 9/1951 | Bloomfield |
| 2,587,255 | A | 2/1952 | Vogel et al. |
| 2,590,315 | A | 3/1952 | Hawley, Jr. |
| 2,659,903 | A | 11/1953 | Hagelfeldt |
| 2,672,627 | A | 3/1954 | Hagelfeldt |

(Continued)

FOREIGN PATENT DOCUMENTS

| | | |
|---|---|---|
| AU | 715883 B3 | 2/2000 |
| DE | 29713646 U1 | 2/1998 |

(Continued)

OTHER PUBLICATIONS

Arm's Reach Universal Co-Sleeper Bassinet; Arm's Reach Concepts, Inc.; 2001; 8 pgs.

(Continued)

*Primary Examiner* — Eric Kurilla

(74) *Attorney, Agent, or Firm* — Gardner Groff Greenwald & Villanueva, PC

(57) ABSTRACT

A child containment device including a frame having at least one upper frame member, and a liner for removable attachment to the frame. The liner includes at least one wall portion for placement inside of the frame, a flap portion for extending over at least a portion of the upper frame member and outside of the frame, and a fastener securable on an exterior surface of the at least one wall portion of the liner.

19 Claims, 5 Drawing Sheets

(56) References Cited

U.S. PATENT DOCUMENTS 2,710,976 A * 6/1955 Martensen ..... A47D 13/063 5/154
2,784,420 A 3/1957 Moltane
2,790,978 A 5/1957 Tigrett
2,873,458 A 2/1959 Adamson
2,948,287 A 8/1960 Rupert
3,018,493 A 1/1962 Wittbrodt
3,078,478 A 2/1963 Sheahan
3,162,865 A 12/1964 Tigrett
3,165,760 A 1/1965 Abajian
3,223,098 A 12/1965 Dole, Jr.
3,273,862 A 9/1966 Miller
3,658,025 A 4/1972 Hood et al.
3,735,430 A 5/1973 Platz
3,848,277 A 11/1974 Reguitti
3,875,623 A 4/1975 Johnston
3,924,280 A 12/1975 Vaiano
4,018,260 A 4/1977 Baslow
D244,890 S 7/1977 Adams
4,070,716 A 1/1978 Satt et al.
4,105,244 A 8/1978 Colby
4,186,454 A 2/1980 Cone
4,202,065 A 5/1980 Sullivan
4,538,309 A 9/1985 Gunter
4,561,138 A 12/1985 Hwang
4,681,368 A 7/1987 Heath et al.
4,695,092 A 9/1987 Hittie
4,710,049 A * 12/1987 Chang ..... A47D 13/063 16/250
4,739,527 A 4/1988 Kohus et al.
4,811,437 A * 3/1989 Dillner ..... A47D 13/063 5/93.1
4,848,843 A 7/1989 Gibbs
4,883,701 A 11/1989 Rankin et al.
4,885,200 A 12/1989 Perdelwitz, Jr. et al.
4,890,346 A 1/1990 Rist
4,891,454 A 1/1990 Perdelwitz, Jr. et al.
4,891,852 A 1/1990 Lopez, Jr.
4,899,496 A 2/1990 Chew, II
4,967,432 A 11/1990 Kujawski et al.
4,984,849 A 1/1991 Rist
4,985,948 A 1/1991 Mariol
5,163,191 A 11/1992 Chan
5,172,435 A 12/1992 Griffin et al.
5,279,006 A 1/1994 Teng
5,332,292 A 7/1994 Price et al.
5,339,470 A 8/1994 Shamie
5,553,336 A 9/1996 Mariol
5,613,543 A 3/1997 Walton
5,642,538 A 7/1997 McAllister
5,697,111 A * 12/1997 Dillner ..... A47D 13/063 5/93.1
5,727,265 A 3/1998 Ziegler et al.
5,778,465 A 7/1998 Myers
D397,882 S 9/1998 Wu
5,806,112 A 9/1998 Harms
5,819,341 A 10/1998 Simantob et al.
5,826,285 A 10/1998 Mariol et al.
5,845,349 A 12/1998 Tharalson et al.
5,862,548 A * 1/1999 Gerhart ..... A47D 13/06 135/117
5,867,850 A 2/1999 Mariol
5,867,851 A 2/1999 Mariol et al.
5,881,408 A 3/1999 Bashista et al.
5,911,478 A 6/1999 Goodman
5,918,329 A 7/1999 Huang
5,974,636 A 11/1999 Brown et al.
5,991,944 A 11/1999 Yang
5,992,348 A 11/1999 Harding
6,004,182 A 12/1999 Pasin
6,023,802 A 2/2000 King
6,035,466 A 3/2000 Homeyer
6,041,455 A 3/2000 Raffo et al.
6,058,528 A 5/2000 Yang
6,067,676 A * 5/2000 Carnahan ..... A47D 13/06 135/116
6,076,448 A 6/2000 Rexroad
6,098,217 A 8/2000 Hammil
6,131,218 A 10/2000 Wang
6,142,565 A 11/2000 Rieder
6,158,067 A 12/2000 Cheng
6,173,462 B1 1/2001 Huang et al.
6,185,762 B1 2/2001 Homeyer
6,192,535 B1 2/2001 Warner, Jr. et al.
6,233,759 B1 5/2001 Warner, Jr. et al.
6,293,624 B1 9/2001 Gaylord et al.
6,301,731 B1 10/2001 Jakubowski et al.
6,332,231 B1 12/2001 Wang
6,370,714 B1 4/2002 Elzenbeck
6,402,116 B1 6/2002 Northup
6,418,575 B1 7/2002 Cheng
6,421,850 B1 7/2002 Welsh, Jr.
6,421,857 B2 7/2002 Whatman et al.
6,430,762 B1 8/2002 Cheng
6,434,767 B1 8/2002 Welsh, Jr.
6,470,516 B2 10/2002 Lopez, Jr.
6,510,570 B2 1/2003 Hartenstine et al.
6,511,562 B1 1/2003 Coffield
6,526,608 B1 3/2003 Hsia
6,536,608 B2 3/2003 Buckley
6,539,563 B1 * 4/2003 Hsia ..... A47D 7/04 248/150
6,543,070 B2 4/2003 Longenecker et al.
6,560,827 B1 5/2003 Gross
6,574,812 B2 6/2003 Jakubowski et al.
6,585,323 B2 7/2003 Gaylord et al.
6,588,033 B1 7/2003 Welsh, Jr. et al.
6,623,079 B2 9/2003 Gregory
6,687,927 B1 2/2004 Tharalson et al.
6,687,928 B1 2/2004 Wilson
6,701,547 B2 3/2004 Hsia
6,704,949 B2 3/2004 Waldman et al.
6,728,980 B1 5/2004 Chen
6,735,796 B2 5/2004 Warner, Jr. et al.
D494,393 S 8/2004 Chen
6,772,457 B1 8/2004 Alaback
6,779,849 B1 8/2004 Harper et al.
6,799,337 B1 10/2004 Raphael-Davis et al.
D500,213 S 12/2004 DeHart et al.
6,859,957 B1 3/2005 Chen
6,859,958 B2 3/2005 LaMantia
6,874,177 B2 4/2005 Hsia
6,895,611 B2 5/2005 Tharalson et al.
6,901,613 B1 6/2005 Hsia
6,931,677 B2 8/2005 Tharalson et al.
6,934,981 B2 8/2005 Waldman et al.
6,954,949 B1 10/2005 Chen
6,959,462 B2 11/2005 Chen
6,961,968 B2 11/2005 Clapper et al.
7,003,823 B1 2/2006 Reed et al.
7,013,505 B2 3/2006 Martin
D518,320 S 4/2006 DeHart et al.
7,055,191 B1 * 6/2006 Chen ..... A47D 13/06 5/93.2
7,055,192 B2 6/2006 Waters et al.
7,063,096 B2 6/2006 Stoeckler
7,111,339 B2 9/2006 Chen
7,228,575 B2 6/2007 Chen
7,263,729 B2 9/2007 Paesang et al.
7,346,943 B2 3/2008 Chen
D572,961 S * 7/2008 Costa ..... D6/610
7,401,366 B1 7/2008 Costa
7,404,219 B2 7/2008 Berkey
7,415,739 B2 8/2008 Tharalson et al.
7,418,745 B2 9/2008 Paesang et al.
7,418,746 B2 9/2008 Gehr et al.
7,458,114 B2 12/2008 Troutman
7,509,694 B2 3/2009 Chen
7,513,001 B1 4/2009 Leach
7,523,513 B2 4/2009 Waters et al.
7,526,821 B2 5/2009 Chen et al.
D594,237 S 6/2009 Gower et al.
7,543,342 B2 6/2009 Zhao et al.

(56) References Cited

U.S. PATENT DOCUMENTS

| | | | | |
|---|---|---|---|---|
| 7,568,242 | B2 | 8/2009 | Troutman | |
| 7,581,269 | B2 | 9/2009 | Chen et al. | |
| 7,739,759 | B2 | 6/2010 | Mendes et al. | |
| 7,748,780 | B2 | 7/2010 | Sizemore | |
| 7,752,688 | B2 | 7/2010 | Chen et al. | |
| 7,752,693 | B2 | 7/2010 | Espenshade | |
| 7,882,579 | B2 | 2/2011 | Jackson et al. | |
| 7,908,686 | B2 | 3/2011 | Clapper et al. | |
| 7,930,776 | B2 | 4/2011 | Chen et al. | |
| 7,937,786 | B2 | 5/2011 | Bergkvist | |
| 7,937,790 | B2 | 5/2011 | Zhao et al. | |
| 7,950,081 | B2 | 5/2011 | Chen et al. | |
| 7,958,578 | B2 | 6/2011 | Shan et al. | |
| 8,001,630 | B2 | 8/2011 | Burkholder et al. | |
| 8,006,326 | B2 | 8/2011 | Thomas et al. | |
| 8,011,036 | B2 | 9/2011 | Tuckey | |
| 8,141,186 | B2 | 3/2012 | Burns et al. | |
| 8,201,291 | B2 | 6/2012 | Burns et al. | |
| 8,220,088 | B2 | 7/2012 | Waters et al. | |
| 8,230,536 | B2 | 7/2012 | Clapper et al. | |
| 8,281,431 | B2 | 10/2012 | Hartenstine | |
| 8,312,575 | B1 | 11/2012 | Maraj | |
| 8,316,481 | B2 | 11/2012 | Arnold, IV et al. | |
| RE43,919 | E | 1/2013 | Chen | |
| 8,424,131 | B2 | 4/2013 | Thomsen et al. | |
| 8,490,227 | B2 | 7/2013 | Troutman | |
| 8,522,374 | B2 | 9/2013 | Sousa et al. | |
| 8,528,130 | B2 | 9/2013 | Bu et al. | |
| 8,544,125 | B2 | 10/2013 | Greger et al. | |
| 8,550,548 | B2 | 10/2013 | Gibbons et al. | |
| 8,566,988 | B2 | 10/2013 | Son et al. | |
| D698,592 | S | 2/2014 | Rivera et al. | |
| D699,063 | S | 2/2014 | Stitchick et al. | |
| 8,656,530 | B2 * | 2/2014 | You | A47D 13/063 5/93.2 |
| 8,657,326 | B2 | 2/2014 | Shaanan et al. | |
| D700,466 | S | 3/2014 | Rivera et al. | |
| 8,661,581 | B2 | 3/2014 | Kaplan et al. | |
| 8,677,526 | B2 | 3/2014 | Li | |
| 8,677,533 | B2 | 3/2014 | Barron et al. | |
| 8,696,400 | B2 | 4/2014 | Fair et al. | |
| 8,739,331 | B2 | 6/2014 | Gillett et al. | |
| 8,745,780 | B2 | 6/2014 | Su | |
| 8,844,072 | B2 | 9/2014 | Bellows et al. | |
| D717,576 | S | 11/2014 | Tan | |
| 8,893,325 | B2 | 11/2014 | Arnold, IV et al. | |
| 8,925,127 | B2 | 1/2015 | Yan et al. | |
| 8,925,128 | B2 | 1/2015 | Fiore, Jr. et al. | |
| 8,943,622 | B2 | 2/2015 | Saint et al. | |
| 8,955,174 | B1 * | 2/2015 | Lawlor | A47D 13/063 5/93.1 |
| 8,997,277 | B2 | 4/2015 | Thomas et al. | |
| 9,021,629 | B2 | 5/2015 | Cheng | |
| 9,066,607 | B1 | 6/2015 | Ransil et al. | |
| 9,078,530 | B2 | 7/2015 | Ingram et al. | |
| 9,149,128 | B2 * | 10/2015 | Rampton | A47D 13/063 |
| 9,226,594 | B2 | 1/2016 | Long | |
| 9,226,595 | B2 | 1/2016 | Jackson | |
| 9,332,860 | B2 | 5/2016 | Rong et al. | |
| 9,351,588 | B2 | 5/2016 | Burns et al. | |
| 9,370,255 | B2 | 6/2016 | Waters et al. | |
| 2001/0001162 | A1 | 5/2001 | Warner, Jr. et al. | |
| 2001/0001330 | A1 | 5/2001 | Warner, Jr. et al. | |
| 2002/0078499 | A1 * | 6/2002 | Cheng | A47D 7/002 5/95 |
| 2003/0061657 | A1 * | 4/2003 | Longenecker | A47D 13/063 5/99.1 |
| 2003/0154547 | A1 * | 8/2003 | Hsia | A47D 7/002 5/99.1 |
| 2003/0177575 | A1 | 9/2003 | Cheng et al. | |
| 2005/0005353 | A1 | 1/2005 | Waldman et al. | |
| 2005/0034232 | A1 * | 2/2005 | Martin | A47D 7/02 5/95 |
| 2005/0150053 | A1 | 7/2005 | Hartenstine | |
| 2005/0217026 | A1 * | 10/2005 | Ramirez | A47C 21/08 5/93.1 |
| 2005/0241064 | A1 | 11/2005 | Lopes et al. | |
| 2005/0262629 | A1 * | 12/2005 | Cheng | A47D 13/063 5/98.1 |
| 2006/0021138 | A1 | 2/2006 | Waldman et al. | |
| 2006/0080776 | A1 | 4/2006 | Clapper et al. | |
| 2006/0225204 | A1 | 10/2006 | Bretschger et al. | |
| 2006/0230528 | A1 | 10/2006 | Church | |
| 2007/0061961 | A1 | 3/2007 | Shamie | |
| 2007/0209112 | A1 | 9/2007 | Waldman et al. | |
| 2007/0251005 | A1 | 11/2007 | Tharalson et al. | |
| 2007/0271697 | A1 | 11/2007 | Martin | |
| 2008/0010742 | A1 | 1/2008 | Tharalson et al. | |
| 2008/0127412 | A1 | 6/2008 | Pleiman et al. | |
| 2008/0258437 | A1 | 10/2008 | Ryan et al. | |
| 2009/0000028 | A1 | 1/2009 | Wang | |
| 2009/0013463 | A1 * | 1/2009 | Cheng | A47D 13/063 5/98.1 |
| 2010/0132115 | A1 * | 6/2010 | Hsu | A47D 13/063 5/98.1 |
| 2010/0138991 | A1 * | 6/2010 | Hartenstine | A47D 13/063 5/99.1 |
| 2010/0263121 | A1 | 10/2010 | Arnold, IV et al. | |
| 2011/0113552 | A1 | 5/2011 | Miller | |
| 2011/0140061 | A1 | 6/2011 | Cheng et al. | |
| 2011/0148155 | A1 | 6/2011 | Chapman et al. | |
| 2011/0148159 | A1 | 6/2011 | Barron et al. | |
| 2011/0163520 | A1 | 7/2011 | Fair et al. | |
| 2011/0308011 | A1 | 12/2011 | Cheng et al. | |
| 2012/0012801 | A1 | 1/2012 | Burns et al. | |
| 2012/0030879 | A1 | 2/2012 | Waters et al. | |
| 2012/0216346 | A1 | 8/2012 | Rampton et al. | |
| 2013/0000036 | A1 | 1/2013 | Wood Greeney et al. | |
| 2013/0117930 | A1 * | 5/2013 | Hsu | A47D 13/063 5/93.1 |
| 2013/0125304 | A1 | 5/2013 | DeHart et al. | |
| 2013/0198952 | A1 | 8/2013 | Rong et al. | |
| 2013/0214574 | A1 | 8/2013 | Chapman et al. | |
| 2013/0312178 | A1 * | 11/2013 | Jackson | A47D 13/06 5/93.1 |
| 2014/0068856 | A1 | 3/2014 | Thomson et al. | |
| 2014/0068857 | A1 | 3/2014 | Jackson et al. | |
| 2014/0075671 | A1 | 3/2014 | Haut et al. | |
| 2016/0066706 | A1 | 3/2016 | Rong et al. | |

FOREIGN PATENT DOCUMENTS

| | | | |
|---|---|---|---|
| DE | 20000537 | U1 | 8/2000 |
| EP | 1878364 | A1 | 1/2008 |
| EP | 2165629 | A1 | 3/2010 |
| EP | 2359719 | A1 | 8/2011 |
| FR | 564019 | A | 12/1923 |
| FR | 1193975 | A | 11/1959 |
| FR | 2775569 | A1 | 9/1999 |
| FR | 2913576 | A1 | 9/2008 |
| GB | 1360375 | A | 7/1974 |
| GB | 2365334 | A | 2/2002 |

OTHER PUBLICATIONS

Baby Trend Model #: 8207BCC Deluxe Trend Nursery Center Instruction Manual; Baby Trend Inc.; 2006; 11 pgs.

Century Care Center Fold 'n Go Instruction Manual; Century Products; 2000; 12 pgs.

Keder—An Education on it's Design & Use; J & J Carter Limited; 2013; 6 pgs.

Kolcraft Travelin Tot Playard Series Instruction Sheet; Kolcraft Enterprises, Inc.; 2006; 22 pgs.

* cited by examiner

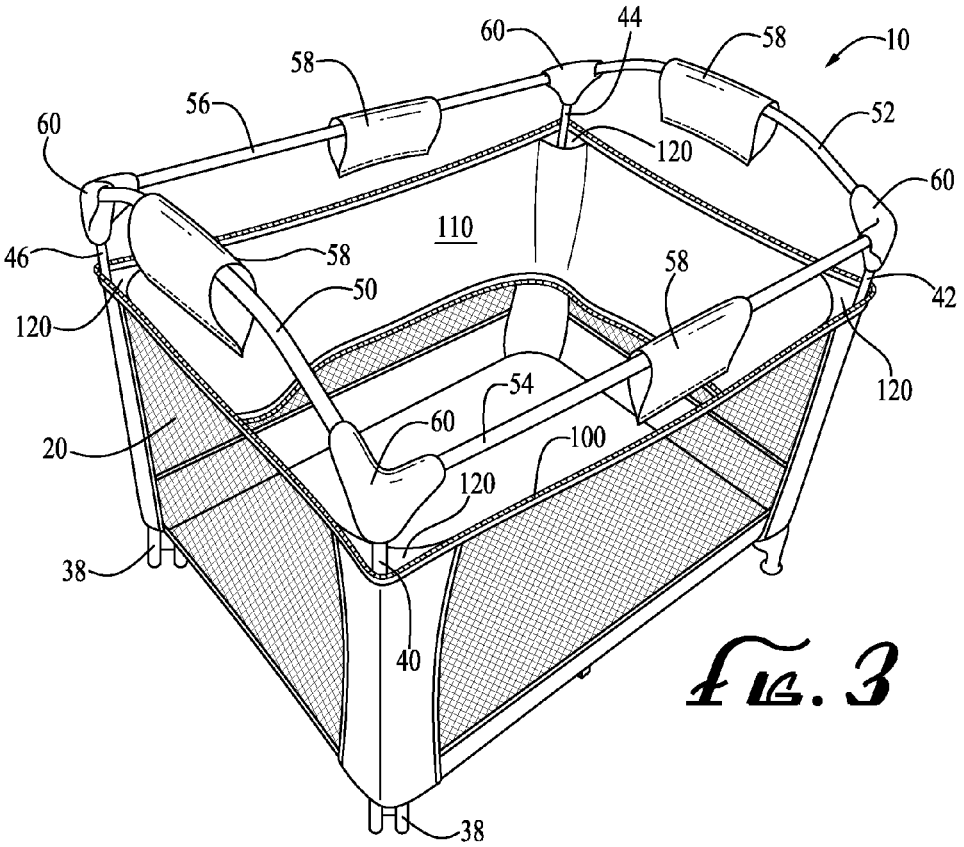
FIG. 3
FIG. 4
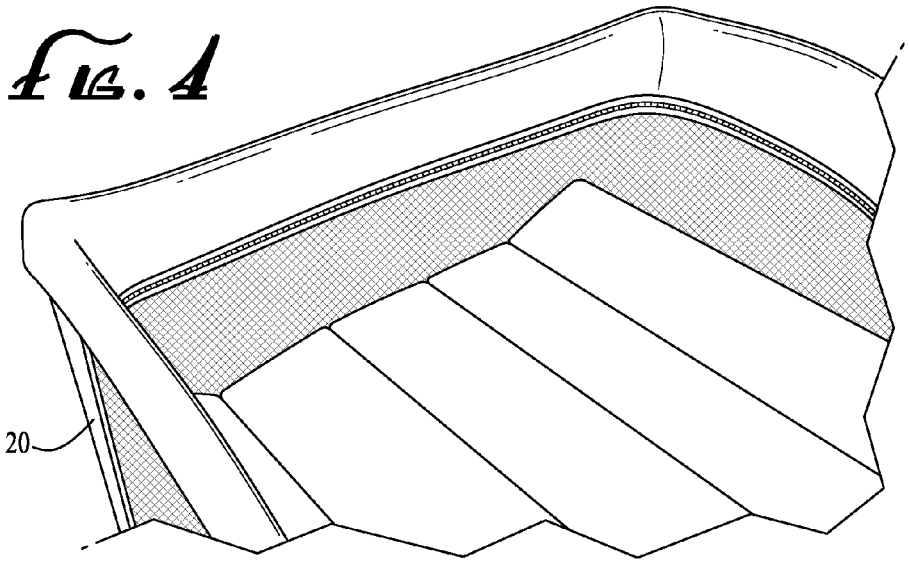

PLAY YARD WITH REMOVABLE LINER

CROSS-REFERENCE TO RELATED APPLICATIONS

This application claims the benefit of U.S. Provisional Patent Application Ser. No. 61/700,828 filed Sep. 13, 2012, the entirety of which is hereby incorporated by reference herein.

TECHNICAL FIELD

The present invention generally relates to the field of childrens' and infants' accessories, and more particularly to an improved child containment device such as a play yard or bassinet having a removable liner with external attachment.

BACKGROUND

Child containment devices such as play yards, play pens, bassinets, cribs, sleepers, cradles, and the like are commonly used to provide a safe and comfortable area for infants and small children to play and rest. Such devices generally include a horizontal floor and vertical walls, and may include a foldable frame structure and fabric panels extending between the frame elements for portability and ease of use.

Continuing improvements are sought in the field of children's products, for example for improved convenience, safety, comfort, and/or performance. Accordingly, it is to the provision of improved child containment systems meeting these and other needs that the present invention is primarily directed.

SUMMARY

In example embodiments, the present invention provides a child containment device with a liner that is removable, for example for laundering or replacement. The liner optionally includes a floor panel, wall panels extending from the floor to the upper frame members of the device, and one or more detachable coupling elements for retaining the liner in place on the frame when in use, and for allowing detachment and removal of the liner when desired. An upper flap portion of the liner preferably extends over the upper frame members of the child containment device when in place, and the detachable coupling element(s) attach on the exterior of the liner. The upper frame members of the child containment device are optionally detachable from the frame uprights or leg members to allow for removal of the liner. The liner optionally includes one or more sleeves for installation over and removal from the frame uprights or leg members when the upper frame members are detached.

In one aspect, the present invention relates to a child containment device including a frame having at least one upper frame member, and a liner for removable attachment to the frame. The liner includes at least one wall portion for placement inside of the frame, a flap portion for extending over at least a portion of the upper frame member and outside of the frame, and a fastener securable on an exterior surface of the at least one wall portion of the liner.

In another aspect, the invention relates to a play yard, the play yard preferably including a frame having one or more substantially horizontal lower frame members configured to define a lower perimeter of the play yard, one or more substantially vertical leg frame members coupled to and extending generally upwardly from the lower frame members, and one or more substantially horizontal upper frame members coupled to the leg frame members and configured to define an upper perimeter of the play yard. The play yard preferably also includes a liner removably coupled to the frame, the liner having a floor panel configured to substantially extend between the lower frame members and configured to define a floor of the play yard, one or more side panels coupled to a least a portion of the perimeter of the floor panel and configured to extend between the leg frame members to define one or more side walls of the play yard, the one or more side panels further including a fastening mechanism coupled to at least a portion of the upper perimeter of the side panel, and a flap coupled at its lower perimeter to the interior surface of the one or more side panels. The flap is preferably configured to extend above and fold over the one or more upper frame members, and includes a mating fastening mechanism coupled to its upper perimeter. The mating fastening mechanism coupled to the upper perimeter of the flap is preferably configured to releasably engage the fastening mechanism on the upper perimeter of the side panels.

In still another aspect, the invention relates to a play yard including a frame having one or more substantially horizontal lower frame members configured to define a lower perimeter of the play yard, one or more substantially vertical leg frame members coupled to and extending generally upwardly from the lower frame members, and one or more substantially horizontal upper frame members coupled to the leg frame members and configured to define an upper perimeter of the play yard. The play yard preferably also includes a liner removably coupled to the frame, the liner having a floor panel configured to substantially extend between the lower frame members and configured to define a floor of the play yard, one or more side panels coupled to at least a portion of the perimeter of the floor panel and configured to extend between the leg frame members to define one or more side walls of the play yard, the one or more side panels further including a fastening mechanism coupled to at least a portion of the external surface of the side panel, and a flap coupled at its lower perimeter to the one or more side panels. The flap is preferably configured to extend above and fold over the one or more upper frame members, and includes a mating fastening mechanism coupled to its upper perimeter. The mating fastening mechanism coupled to the upper perimeter of the flap is preferably configured to releasably engage the fastening mechanism on the external surface of the one or more side panels.

In another aspect, the invention relates to a removable liner for a child containment system incorporating a frame. The liner preferably includes a floor panel, at least one wall panel defining an interior surface and an exterior surface, a flap for positioning over an upper frame member of the frame of the child containment system, and a fastener for attaching the flap to the exterior surface of the at least one wall panel.

In another aspect, the invention relates to a method of removal of a liner from a child containment device, the child containment device including a frame having at least one leg member and at least one upper frame member. The method preferably includes decoupling the upper frame member of the frame from the leg member of the frame, and detaching a sleeve portion of the liner from the leg member of the frame.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

BRIEF DESCRIPTION OF THE DRAWINGS

FIG. 3 is a perspective view of the child containment device of FIG. 1, with the liner further detached.

FIG. 4 is a detailed view of a portion of the child containment device of FIG. 1, with a removable mattress installed therein.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
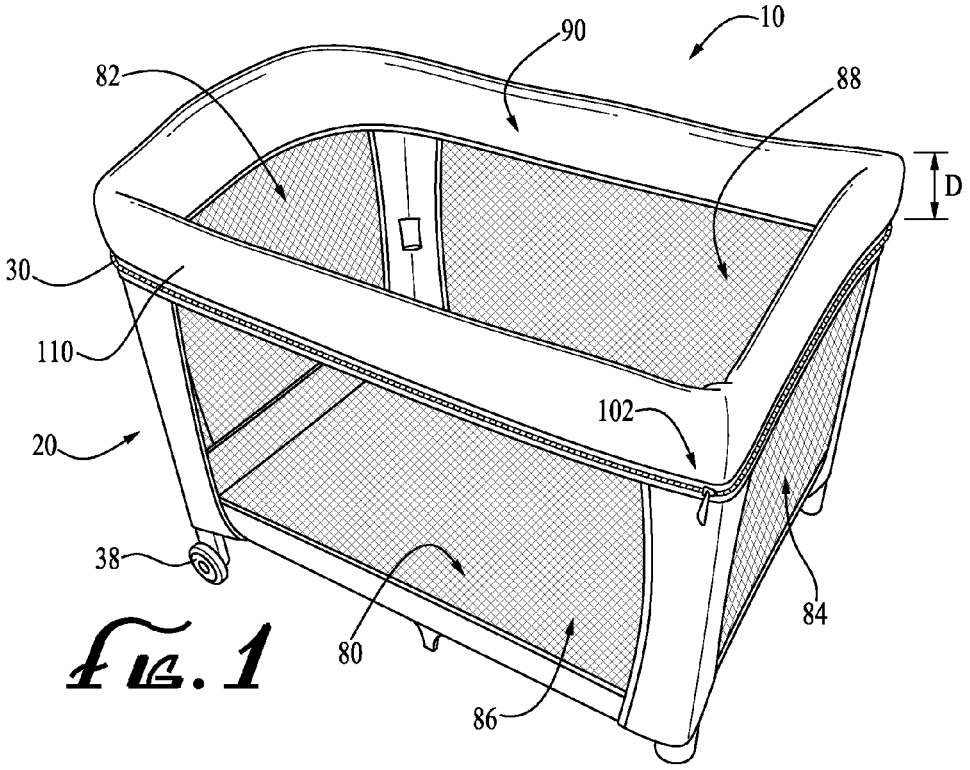
FIG. 1 is a perspective view of a child containment device having a removable liner with external attachment, according to an example embodiment of the present invention.
Figure 2:
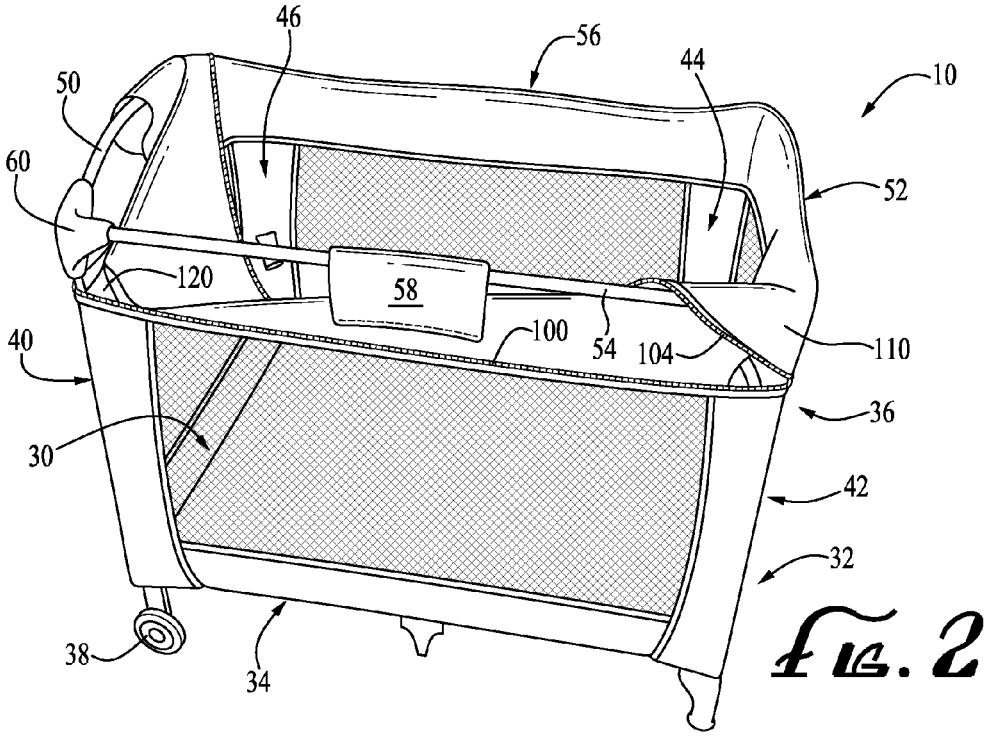
FIG. 2 is a perspective view of the child containment device of FIG. 1, with the liner partially detached.

With reference now to the drawing figures, wherein like reference numbers represent corresponding parts throughout the several views, FIG. 1 shows a child containment device 10 having a removable liner 20 with external attachment 22, according to an example embodiment of the invention. In the depicted embodiment, the child containment device 10 is a play yard, but in alternate embodiments of the invention may comprise a play yard, play pen, bassinet, crib, sleeper, cradle, rocker, or other child containment device having a structural frame and soft goods such as fabric attached to the frame.

The play yard 10 comprises a structural frame comprising one or more substantially horizontal lower frame members configured to define a lower perimeter of the play yard. In the depicted embodiment, these include first and second end lower frame members or rails 30, 32, and first and second side lower frame members or rails 34, 36, which together define lower frame assembly having a generally rectangular lower frame perimeter. Adjacent end and side lower frame members are optionally coupled by hinge connections or other movable couplings to allow the frame to fold or contract for compact storage and transport. Optionally, one or more of the end and/or side lower frame members can comprise multiple segments coupled together, as by hinges, telescoping members, snap couplings, or other joint assemblies allowing interchangeability between an expanded state for use and a compact state for storage and transport. One or more casters or wheels 38 are optionally mounted to the lower frame assembly for ease of transport.

The structural frame further comprises one or more substantially vertical legs or upright frame members extending upwardly from the lower frame of the play yard. In the depicted embodiment, four legs or upright frame members 40, 42, 44, 46 extend upwardly from corners of the lower frame assembly. The legs or upright frame members 40, 42, 44, 46 are optionally pivotally coupled at their lower ends to the lower frame assembly by hinge joints, or otherwise configured for folding to a compact configuration.

The structural frame further comprises one or more substantially horizontal upper frame members or rails coupled to upper ends of the legs or upright frame members. In the depicted embodiment, these upper frame members comprise first and second end upper frame members 50, 52, and first and second side upper frame members 54, 56. Adjacent end and side upper frame members are optionally coupled by hinge connections or other movable couplings to allow the frame to fold or contract for compact storage and transport. Optionally, one or more of the upper frame members 50, 52, 54, 56 can comprise multiple segments coupled together, as by hinges, telescoping members, snap couplings, or other joint assemblies allowing interchangeability between an expanded state for use and a compact state for storage and transport. Padded sleeves or cushioning covers 58 are optionally provided on the upper frame members 50, 52, 54, 56 for safety and comfort during use.

Upper corner attachment hubs 60 are optionally provided, to connect adjacent ends of the upper frame members 50, 52, 54, 56 together at corners of the upper frame assembly, and to connect the upper frame assembly to the legs or upright frame members 40, 42, 44, 46. In example form, the corner attachment hubs 60 are plastic moldings having ferrules, sockets or female receiver channels or openings to receive and engage ends of the frame members. The attachment hubs 60 can comprise snap couplings or other detachable couplings for releasably engaging the ends of the frame members for assembly and disassembly. The frame members preferably comprise structural members of sufficient strength and rigidity to support the intended load without undue strain or flexure, for example being fabricated from aluminum or steel tubing, other metals, plastics, composites or other material(s) of construction.

The liner 20 of the child containment device 10 is preferably removably coupled to the frame, allowing the liner to be removed as for laundering, replacement, storage or other purposes. In example forms, the liner 20 comprises a floor panel 80, first and second end wall panels 82, 84 attached at ends of the floor panel, and first and second side wall panels 86, 88 attached at sides of the floor panel. The floor panel 80 is preferably sized and shaped to generally conform to the size and shape of the lower frame assembly, having a length generally corresponding to the distance between first and second end lower frame members 30, 32, and a width generally corresponding to the distance between first and second side lower frame members 34, 36. Adjacent edges of end wall panels 82, 84 and side wall panels 86, 88 are attached, as by stitching, adhesive, fasteners or otherwise to form corners of a generally rectangular three-dimensional prismatic or cubic contained volume of the liner when assembled and mounted onto the frame. The liner is preferably formed of a fabric, sheeting or other flexible material, and one or more of the wall panels 82, 84, 86, 88 optionally comprise a mesh or transparent portion allowing visibility and/or airflow therethrough.

The end wall panels 82, 84 have a length generally corresponding to the distance between upright legs 40, 42, 44, 46 at the ends of the frame assembly and a height generally corresponding to the height of the upright legs, and extend between the upright legs at the ends of the frame assembly when the liner is mounted onto the frame. The side wall panels 86, 88 have a length generally corresponding to the distance between upright legs 40, 42, 44, 46 at the sides of the frame assembly and a height generally corresponding to the height of the upright legs, and extend between the upright legs at the sides of the frame assembly when the liner is mounted onto the frame. The floor and wall panels of the liner 20 can comprise separate pieces of material joined together by stitching, adhesive or otherwise, or can comprise integral portions of a unitary piece of material.

The liner 20 thus defines an interior surface and an exterior surface, and bounds a generally rectangular three-dimensional contained space 90 within its interior, which forms the child containment space of the device 10. A first component 100 of a fastener 102 is attached along at least a portion of the exterior periphery of the liner 20. In example form, the fastener 102 is a zipper, and the first component 100 comprises one side of the zipper. In alternate embodiments, the fastener may comprise a hook-and-loop fastener system, one or more buttons, snaps, hooks, clips or other fasteners.

The liner 20 further comprises a flap or skirt 110 extending from at least a portion of the upper edge of the liner's wall panels 82, 84, 86, 88. The flap portion 110 can be attached to the wall panels 82, 84, 86, 88 by stitching, adhesive or otherwise, or the flap portion can comprise an integral extension of the wall panels, for example with the wall portion(s) and flap portion(s) of the liner 20 formed from a continuous sheet of material. When assembled and installed, the flap 110 extends above and over at least a portion of one or more of the upper frame rails 50, 52, 54, 56 and padding 58, and overlies at least a portion of the exterior face of one or more of the liner's wall panels 82, 84, 86, 88. Thus, when the frame is assembled and the liner 20 installed, the wall panels 82, 84, 86, 88 are arranged inside of the frame, and the flap 110 extends over the upper frame assembly and at least a portion of the flap is arranged outside of the frame. A second component 104 of the fastener 102 is attached along at least a portion of the flap 110, for example at or proximal the distal or free edge of the flap. The second component 104 is releasably engageable with the first component 100 of the fastener 102 along at least a portion of the exterior surface of the liner 20, for example by zipping or otherwise attaching the first and second components together about the exterior periphery of the liner, to hold the liner in place on the frame of the child containment device 10. A single fastener 102 may extend about all or a substantial portion of the periphery of the liner's exterior, or alternatively two or more fasteners can be positioned along portions of the liner's exterior. When the frame is erected and the liner 20 installed and attached, the fastener 102 is preferably positioned on the exterior of the liner a distance D below the top of the frame assembly sufficient to provide ease of operation by a caregiver outside of the child containment device 10, but outside of easy reach by a child inside of the device.

Figure 5:
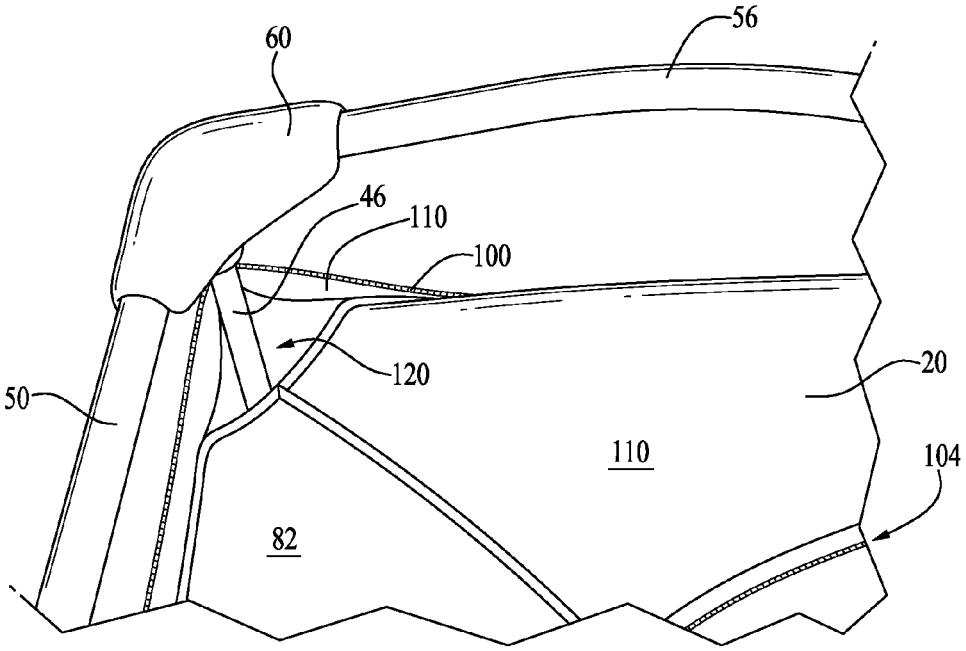
FIG. 5 is a detailed view of a corner portion of the child containment device of FIG. 1, showing a liner sleeve installed over a corner post or upright leg member of the device frame.

As seen best with reference to FIGS. 3 and 5, the liner 20 further comprises a sleeve 120 at each corner for receiving and sliding over one of the upright legs 40, 42, 44, 46 of the frame assembly to attach the liner to the frame of the child containment device 10. In example embodiments, the sleeve 120 extends continuously along the height of the liner's wall panels 82, 84, 86, 88, formed for example by a panel of fabric or other material attached to the wall panels adjacent the corners a short distance from the corner seam, forming a generally triangular channel or sleeve which can slide over the upright leg 40, 42, 44 or 46 at that corner. Alternatively, one or more straps or strips of material forming one or more loops at the corners of the liner define a sleeve 120 along at least one or more portions of the height of the liner's wall panels 82, 84, 86, 88. In still further alternative embodiments, the sleeve 120 is an integral extension of the liner's wall panels 82, 84, 86, 88, formed for example by stitching, adhesive or other attachment means to define a channel through which one of the upright legs 40, 42, 44 or 46 may be received. When the device 10 is assembled and the liner 20 installed, the liner preferably defines a complete and continuous containment surface bounding the interior contained space 90 and covering the frame to prevent a child inside the device from contacting any of the frame members and protecting the child from potential pinch points between frame members.

Figure 6A:
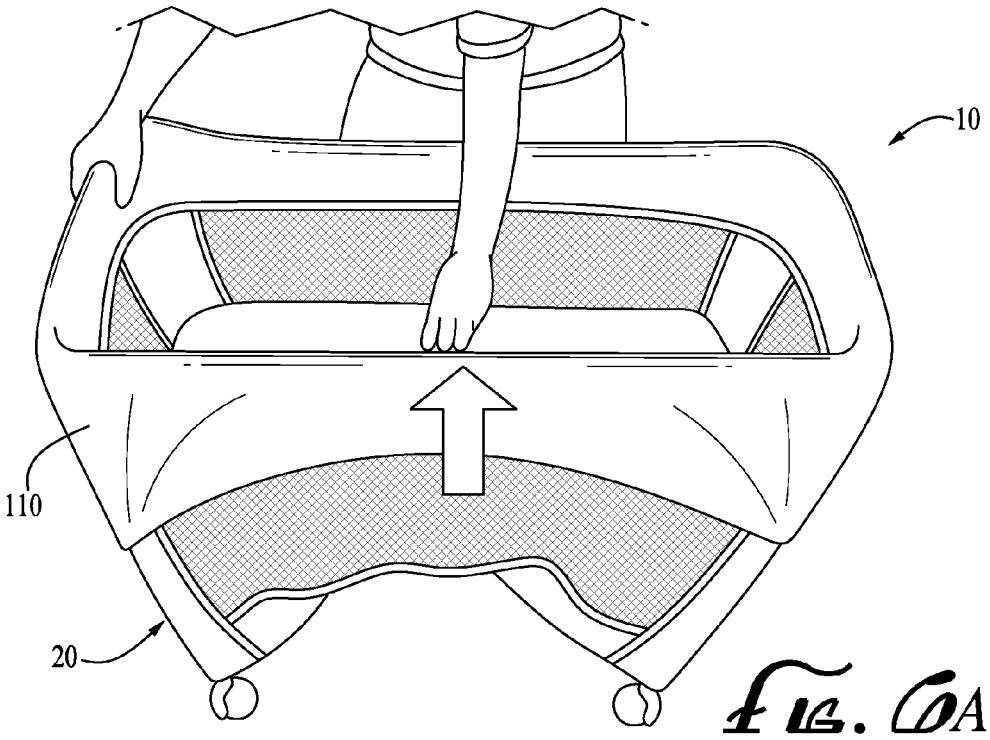
FIGS. 6A-6E show a sequence of operation, for removal of the liner of the child containment device of FIG. 1.
Figure 6B:
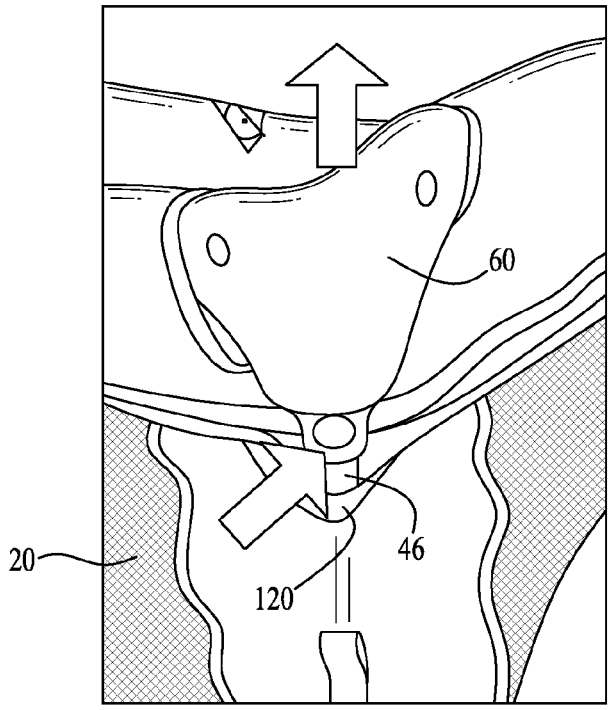
Figure 6C:
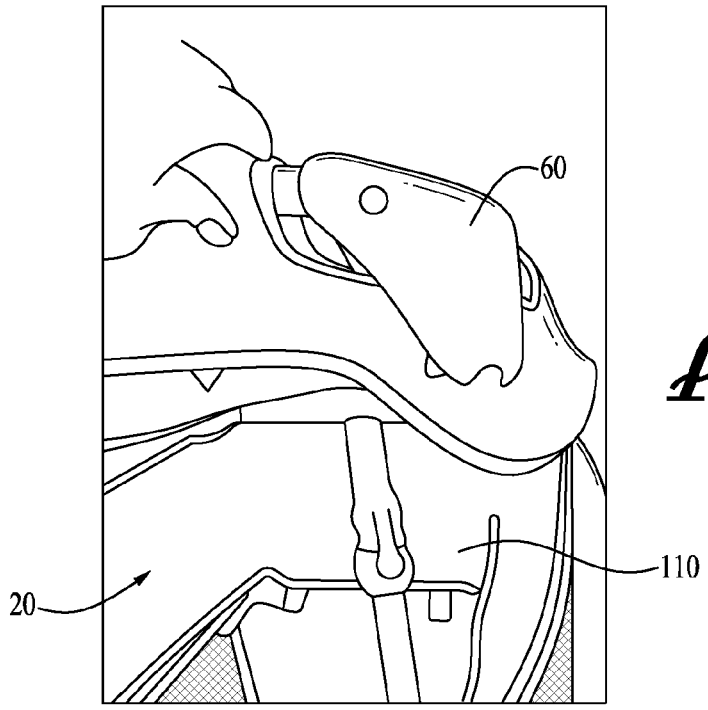
Figure 6D:
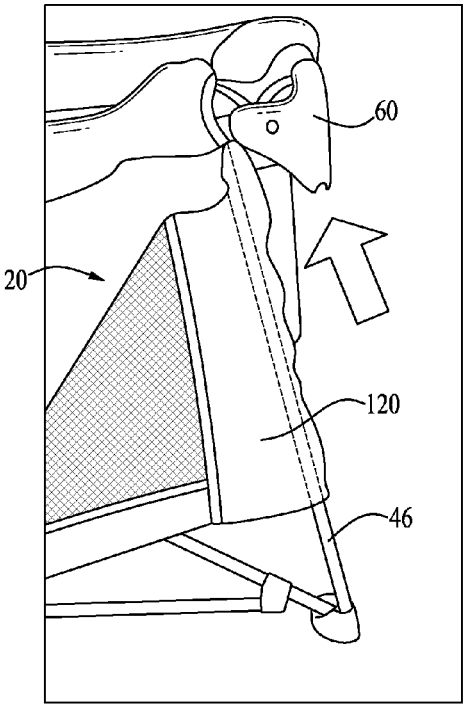
Figure 6E:
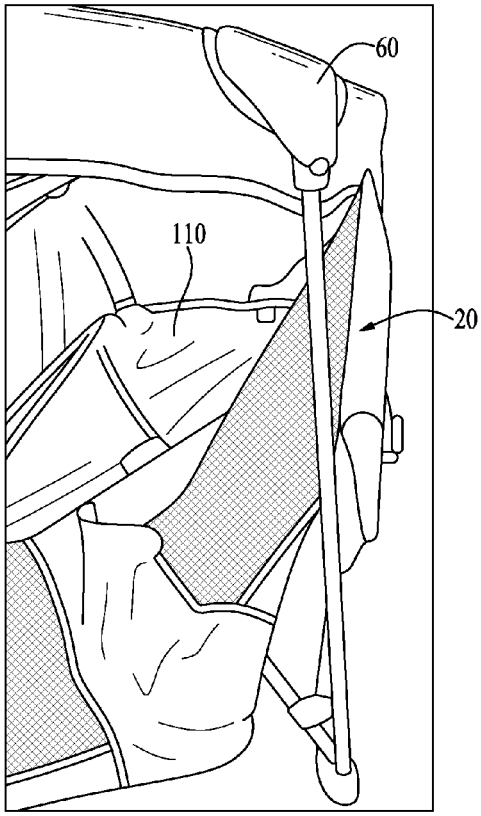

FIGS. 6A-6E show a sequence of operation of removal of the liner 20 from the frame of the child containment device 10, according to an example method of use of the present invention. The fastener 102 of the liner is unfastened, for example by unzipping the first and second fastener components 100, 104 about the exterior periphery of the liner 20. In example embodiments wherein the child containment device 10 is foldable or collapsible, the frame release mechanism is actuated and the frame is partially folded or collapsed (FIG. 6A), thereby loosening the liner 20 and allowing for freedom of movement of the liner relative to the frame. The flap 110 of the liner is then pulled over and off of the upper frame members 50, 52, 54, 56 and folded down into the inside of the frame. Working sequentially at each corner of the device 10, the user then decouples the attachment hubs 60 from their respective upright leg 40, 42, 44 and 46 (FIGS. 6B, 6C). The liner 20 is then detached from the frame at each corner by pulling the sleeve 120 of the liner off of its respective upright leg 40, 42, 44 and 46 (FIG. 6D). The attachment hub 60 can be replaced onto its respective upright leg 40, 42, 44 and 46 after the sleeve 120 has been pulled off of the leg. After the sleeves 120 of the liner 20 have been removed from the upright legs 40, 42, 44, 46 at each corner (FIG. 6E), the liner is free of the frame and may be removed for laundering or replacement. The sequence is reversed for reinstallation of a liner onto the frame.

While the invention has been described with reference to preferred and example embodiments, it will be understood by those skilled in the art that a variety of modifications, additions and deletions are within the scope of the invention, as defined by the following claims. Moreover, the particular configurations, suggested materials of construction, and objectives described herein are merely exemplary and are in no way limiting.

What is claimed is:

1. A child containment device comprising:

a frame comprising a plurality of upper frame members, a plurality of lower frame members, and a plurality of upright leg members extending between the lower frame members and the upper frame members, the frame defining an interior volume of the child containment device;

a plurality of attachment hubs, each attachment hub detachably coupling a respective upright leg member to at least one of the upper frame members, each attachment hub comprising a snap coupling for releasably engaging and coupling directly to an end of the respective upright leg member; and a liner for removable attachment to the frame, said liner comprising a floor panel, a plurality of wall portions for placement inside of the frame, at least one sleeve extending along the plurality of wall portions of the liner configured for receiving and sliding over a respective upright leg member, a flap portion comprising an extension of at least one of the plurality of wall portions configured to extend over the upper frame members and outside of the frame, and at least one fastener for securing the flap to an exterior surface of the at least one wall portion to removably attach the liner to the frame.

2. The child containment device of claim 1, wherein the fastener is a zipper.

3. The child containment device of claim 2, wherein the zipper comprises a first zipper component extending along at least a portion of the exterior surface of the at least one wall portion of the liner, and a second zipper component along at least a portion of the flap portion of the liner.

4. The child containment device of claim 2, wherein the zipper comprises a first zipper portion extending about all of a periphery of the exterior surface of the liner, and a second zipper component extending along all of a periphery of the flap portion of the liner.

5. The child containment device of claim 1, wherein the liner defines an interior contained space of the device when the device is assembled and the liner is installed, and wherein the liner defines a complete and continuous containment surface bounding the interior contained space, wherein a child within the interior contained space is prevented from contacting the frame.

6. The child containment device of claim 1, further comprising a padded sleeve over at least a portion of the upper frame members, and wherein the flap of the liner extends over the padded sleeve when the liner is installed and attached onto the frame.

7. The child containment device of claim 1, comprising a play yard.

8. The child containment device of claim 7, wherein the frame of the play yard is collapsible between an upright and expanded assembled configuration and a compact taken down configuration.

9. The child containment device of claim 1, wherein the liner comprises a fabric, and the at least one wall portion at least partially comprises a mesh material allowing visibility therethrough.

10. The child containment device of claim 1, wherein the liner comprises a rectangular shaped floor panel and four wall portions and wherein the frame comprises four upper frame members and four upright leg members.

11. A play yard comprising:

a frame comprising:

a plurality of substantially horizontal lower frame members configured to define a lower perimeter of the play yard;

a plurality of substantially vertical leg frame members coupled to and extending generally upwardly from the lower frame members; and a plurality of substantially horizontal upper frame members coupled to and supported by the leg frame members and configured to define an upper perimeter of the play yard; and a liner removably coupled to the frame, the liner comprising:

a floor panel configured to substantially extend between the lower frame members and configured to define a floor of the play yard;

one or more side panels coupled to a least a portion of a perimeter of the floor panel and configured to extend between around the leg frame members to define one or more side wall of the play yard, the one or more side panels further including a first fastener element of a fastening mechanism on an outside face of at least one of the side panels;

a flap comprising an extension of the one or more side panels, the flap being configured to extend above and fold over the one or more upper frame members, and including a second fastener element on the flap for releasably fastening with the first fastener element of the fastening mechanism on the outside face of at least one of the side panels; and the liner further comprising one or more sleeves extending along the side panels and configured for receiving and sliding over a respective leg frame member, wherein the one or more sleeves covers an entire outer periphery of at least a portion of the respective leg frame member.

12. The play yard of claim 11, further comprising an attachment hub detachably coupling each of the leg frame members to the upper frame members.

13. The play yard of claim 11, wherein the fastening mechanism comprises a zipper.

14. The play yard of claim 11, wherein the sleeve is constructed of fabric.

15. The play yard of claim 11, wherein the sleeve extends continuously along a height of the one or more side panels of the liner.

16. The play yard of claim 11, wherein the frame comprises four vertical leg frame members and four horizontal upper frame members and wherein the liner comprises a rectangular shaped floor panel and four sleeves.

17. A play yard comprising:

a frame comprising:

a plurality of substantially horizontal lower frame members configured to define a lower perimeter of the play yard;

a plurality of substantially vertical leg frame members coupled to and extending generally upwardly from the lower frame members;

a plurality of substantially horizontal upper frame members coupled to the leg frame members; and an attachment hub detachably coupling each of the leg frame members to the upper frame members, wherein the upper frame members and the attachment hubs define an upper perimeter of the play yard, wherein each attachment hub is directly attached to an of end of a respective leg frame member;

a liner removably coupled to the frame, the liner comprising:

a floor panel configured to substantially extend between the lower frame members and configured to define a floor of the play yard;

one or more side panels coupled to a least a portion of a perimeter of the floor panel and configured to extend between the leg frame members to define one or more side wall of the play yard, the liner further comprising sleeves extending along the side panels configured for receiving and sliding over the respective leg frame member, the one or more side panels further including a first fastener element of a fastening mechanism coupled to the outside of at least one of the side panels; and a flap comprising an extension of at least one of the side panels, the flap comprising a second fastener element of the fastening mechanism;

wherein the second fastener element of the fastening mechanism is configured to releasably engage the first fastener element of the fastening mechanism on the outside of the at least one side panel;

wherein the liner is detachably coupled to the frame by detaching the attachment hubs from each of the lea frame members, sliding the sleeves over the respective leg frame members, reattaching the attachment hubs to each of the leg frame members, folding the liner flap over at least one of the horizontal upper frame members and engaging the first and second fastener elements of the fastening mechanism with one another on the outside of the at least one side panel; and wherein the liner defines an interior contained space of the play yard when the play yard is assembled and the liner is installed, and wherein the liner defines a complete and continuous containment surface bounding the interior contained space, wherein a child within the interior space is prevented from contacting the upper perimeter of the frame including the upper frame members and attachment hubs.

18. The play yard of claim 17, herein the fastening mechanism comprises a zipper.

19. The play yard of claim 17, wherein the frame comprises four vertical leg frame members and four horizontal upper frame members and wherein the liner comprises a rectangular shaped floor panel and four sleeves.

* * * * *